US008800789B2

(12) United States Patent
Sharp

(10) Patent No.: US 8,800,789 B2
(45) Date of Patent: Aug. 12, 2014

(54) EARRING ORGANIZER

(76) Inventor: Virginia M. Sharp, Elizabethtown, KY (US)

( * ) Notice: Subject to any disclaimer, the term of this patent is extended or adjusted under 35 U.S.C. 154(b) by 108 days.

(21) Appl. No.: 13/373,949

(22) Filed: Dec. 6, 2011

(65) Prior Publication Data

US 2013/0140256 A1 Jun. 6, 2013

(51) Int. Cl.
*A47F 7/02* (2006.01)

(52) U.S. Cl.
USPC ..... 211/85.2; 211/87.01

(58) Field of Classification Search
USPC ..... 211/10, 11, 85.2, 85.5, 85.9, 16, 45, 46, 211/1, 50, 87.01, 88.04, 94.03, 119.009, 211/113, 118, 123, 44, 85.3, 86.01, 89.01, 211/193; 206/6.1, 279, 336, 348, 49, 495, 206/566; D3/903; 248/121, 127; D6/566
See application file for complete search history.

(56) References Cited

U.S. PATENT DOCUMENTS

| | | | | | |
|---|---|---|---|---|---|
| 405,955 | A | * | 6/1889 | Feineman | 211/45 |
| 740,001 | A | * | 9/1903 | Flanagin | 312/34.8 |
| 790,112 | A | * | 5/1905 | Cummings | 211/89.01 |
| 959,112 | A | * | 5/1910 | Oleary | 211/45 |
| 1,273,894 | A | * | 7/1918 | Madison | 206/564 |
| 1,578,117 | A | * | 3/1926 | Gahring | 38/102 |
| 1,994,981 | A | * | 3/1935 | Cook | 434/75 |
| 1,997,490 | A | * | 4/1935 | Hoar | 211/89.01 |
| 3,094,216 | A | * | 6/1963 | Gordon | 211/45 |
| 3,315,814 | A | * | 4/1967 | Korsen | 211/45 |
| 3,421,634 | A | * | 1/1969 | Huth | 211/123 |
| 3,472,387 | A | * | 10/1969 | Olsen | 211/45 |
| 4,420,084 | A | | 12/1983 | Whelan | |
| 4,446,974 | A | * | 5/1984 | Ott | 211/45 |
| 4,606,458 | A | | 8/1986 | LaBate | |
| 4,760,920 | A | * | 8/1988 | Thomsen | 206/495 |
| 4,767,011 | A | | 8/1988 | Butler | |
| 4,811,996 | A | * | 3/1989 | Hansson | 312/132 |
| 4,843,977 | A | * | 7/1989 | Bridges | 108/152 |
| 4,905,821 | A | | 3/1990 | Corbett | |
| 4,948,202 | A | * | 8/1990 | Helseth | 312/35 |
| D313,906 | S | | 1/1991 | Lublin | |
| 5,067,617 | A | * | 11/1991 | Caldwell et al. | 211/85.2 |
| 5,117,971 | A | * | 6/1992 | Fisher | 206/6.1 |
| D335,768 | S | | 5/1993 | Romo | |
| 5,213,400 | A | * | 5/1993 | Helseth | 312/35 |
| 5,232,431 | A | * | 8/1993 | Helseth | 493/352 |
| 5,261,529 | A | * | 11/1993 | Holland | 206/6.1 |
| D343,749 | S | | 2/1994 | Thompson | |
| 5,295,587 | A | | 3/1994 | Downes et al. | |
| 5,363,953 | A | | 11/1994 | Carter | |
| D363,602 | S | | 10/1995 | Asher | |
| 5,584,404 | A | * | 12/1996 | Tsai | 211/94.01 |
| D382,731 | S | | 8/1997 | Martin | |
| D391,756 | S | | 3/1998 | Horne | |

(Continued)

*Primary Examiner* — Jonathan Liu
*Assistant Examiner* — Stanton L Krycinski
(74) *Attorney, Agent, or Firm* — Carrithers Law Office, PLLC

(57) ABSTRACT

A device for organizing, storing and displaying earrings, pins, brooches and the like which are removably supported and held in place on at least one sheet of material and preferably a plurality of sheets of material hanging from a horizontal rod(s) or spindle(s) supported by arms extending from a vertical frame extending from a base. The spaced apart parallel support arms extend outwardly from the face of the frame a selected distance above the base and include positioning means at selected intervals hold the rod(s) supporting a sheet of fabric, mesh or woven panels to which the earrings, pins and brooches are attached.

3 Claims, 4 Drawing Sheets

(56) References Cited * cited by examiner

U.S. PATENT DOCUMENTS

| | | | |
|---|---|---|---|
| D474,353 | S | 5/2003 | Skinner |
| D587,493 | S | 3/2009 | Skidis |
| 2010/0170810 | A1 | 7/2010 | Shulman |

EARRING ORGANIZER

TECHNICAL FIELD

The present invention relates to the field jewelry display and storage devices.

BACKGROUND OF THE INVENTION

Jewelry is typically stored in jewelry boxes. However, boxes having a plurality of drawers require the individual drawers to be removed to view a large assortment of jewelry such as earrings and are limited in some applications as a neat and organized way of storing jewelry. The earrings, pins and brooches are piled up together causing a twisted snarled mess which leads to torn, broken and/or lost pieces. Further, finding a sought after piece of jewelry is made that much more difficult in this messy and disorganized sort of storage medium. Multiply these difficulties by two when a user finds one earring but now has to find the matching earring.

Display racks in department or jewelry stores typically comprise small cubicles which are configured as a carousel to hold a small card on which are fastened a pair of earrings or a pin. This form of storage is practical in a store but is too space consuming and ill suited to home use.

DESCRIPTION OF THE RELATED ART

U.S. Pat. No. 5,295,587 by Downes et al. for EARRING AND BROOCH ORGANIZER issued on Mar. 22, 1994 teaches a two layers of fabric attached to a standard clothes hanger. Downes includes a few patches of lacy material which are sewn along their top edges to the fabric panels to which additional earrings may be attached. Downs does not include a supporting rack or multiple fabric panels.

U.S. Pat. No. 4,767,011 by Butler for EARRING HOLDER issued on Aug. 30, 1988 teaches a frame covered in a loosely stretched material to which jewelry may be attached. Various embodiments of Butler's frame have multiple panels, some of which are fixed to each other and some are hinged. One contains four fixed panels on a turn table. These multi-panel units are very space consuming and clumsy to use.

US Patent Publication Application No. 20100170810 by Shulman which published on Jul. 8, 2010 teaches a plastic panel with a plurality of rows and columns of perforations into which may placed jewelry posts or wherein cord may be threaded to facility the hanging of jewelry. Shulman is very unattractive, time consuming and awkward to use and very inefficient regarding the amount of space which is required to store the panel.

U.S. Pat. No. 4,606,458 by LeBate for JEWELRY HOLDING DEVICE issued on Aug. 19, 1986 teaches a mesh or woven material stretched over a frame. The frame may include a mirror.

SUMMARY OF THE INVENTION

The present device comprises, consist essentially of, or consists of a device for organizing, storing and displaying earrings, pins, brooches and the like having a pin or piercing pointed attachment means which are removably supported and held in place on a sheet of material hanging from a removable horizontal rod or spindle supported by a vertical frame. More particular, the frame further comprises an upright rack extending at a right angle from a base whereby the vertical planar frame means including a front surface defining a face and a rear surface defining a back. The pair of spaced apart parallel support arms extend outwardly from the face of the planar frame a selected distance above the base. Positioning means are provided at selected intervals on the support arms which hold at least one and preferably two or more rods, spindles, or other longitudinal holding members each one supporting a sheet extending between the arms whereby each rod supports a panel or sheet of pierceable material composed or synthetic or natural material preferably of a mesh or woven fabric panels to which the earrings, pins and brooches are attached by insertion of a post projecting from the rear surface of the earring and held to a supporting object by a clasp, cap, or spring clip means. The posts of the jewelry pieces pierce through the woven panel and are held in place either by friction or by a cap which is pressed onto the end of the post or by a hook extending from the jewelry. The fabric panels are held in a spaced apart relationship on the support arms so that the jewelry on the panels behind the front panel are visible and the individual sheets or panels are easily removed for access or rearranged and organized toward the front for clearer viewing and use.

It is an object of this invention to provide a jewelry organizer containing a rack with two supporting arms and a plurality of fabric panels suspended from a longitudinal member which is configured to be cradled by the two supporting arms.

It is an object of this invention to provide a jewelry organizer wherein supporting arms attached to a rack are configured to hold multiple sheets or panels suspended on spindles in a spaced apart configuration which enables a user to look between adjacent panels to quickly find a particularly desired item or items whereby the sheet can be removed providing easy access to the jewelry clasps.

It is an object of this invention to provide a jewelry organizer which is space saving due to the parallel storage of panels on a support rack.

It is another object of the present invention to include multiple panels which are stored parallel to one another in a spaced apart in a space saving configuration wherein the individual panels are readily removed, examined and restored to a selected position on the supporting arms of the rack.

It is an object of this invention to provide a jewelry organizer including a panel supporting rack wherein individual panels are capable of being removed, examined and/or repositioned on the rack The present device comprises, consist essentially of or consists of a device for organizing, storing and displaying earrings, pins, brooches and the like having a pin or piercing pointed attachment means which are removably supported and held in place on a sheet of material hanging from a removable horizontal rod or spindle supported by a pair of arms projecting from a frame having a vertical frame mounting to a base member. The present invention is presented as a fully constructed unit fabricated from wood or available as a kit, or molded or constructed of a synthetic or plastic material such as fiberglass or a plastic wherein the base, frame and arms may be molded in pieces and assembled or molded as a single integral unit.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a jewelry organizer device and more particularly an earring organizer 10 as shown in FIGS. 1-7.

More particular, the earring organizer 10 comprises an upright support member 12 extending vertically at a right angle from a horizontal base 19 whereby the support member 12 defines a vertical planar frame means including a front surface defining a face and a rear surface defining a back. It is contemplated that the support member 12 could comprise a single post or plurality of members extending from the base 19.

Figure 8:
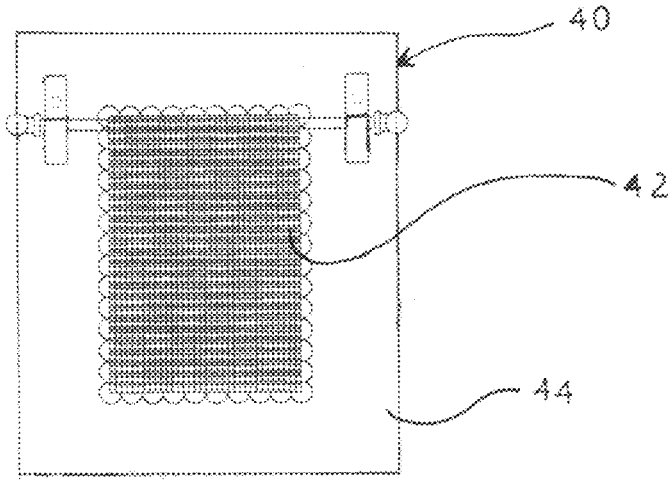
FIG. 8 is a front view of an alternate embodiment showing a frame without the base for mounting onto a wall and showing a panel weave of a different texture.

One preferred embodiment includes a base 19 a flat horizontal planar member having a rear or back portion, for instance the rear edge, attached to a frame comprising a vertical wall 12 which defines a flat planar member. As an alternative to a single flat planar member or one or more arms or other vertically oriented support structures such as columns can extend upward from the base. In the embodiment shown in FIG. 1 the edge of the base attaches to the edge of the vertical frame in order to permit the organizer 10 to be free standing or be mounted with the back of the planar member 12 supported flush against a wall by a holding means such as a screw or nail. It is contemplated that the frame can be mounted onto a base at another selected position for use as a stand or that the base 19 can be removed (or retained for additional storage space) for mounting the organizer on a wall as best illustrated in FIG. 8 showing a ear ring organizer 40 having a rectangular panel 44 and panel having a woven sheet 42. The base 19 can be handedly mounted to the frame and attached by an adhesive, nails, screws, pegs, or tongue and groove arrangement.

Figure 1:
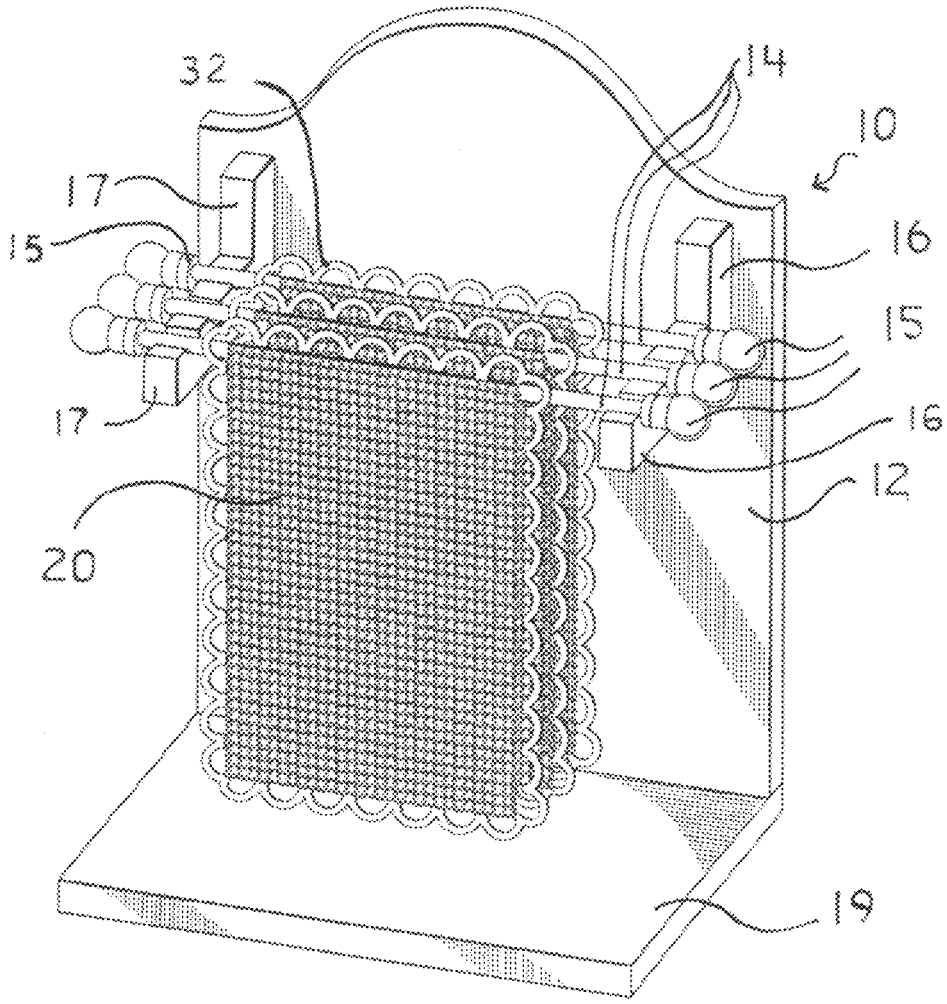
FIG. 1 is a perspective view of the earring organizer showing the planar vertical frame having spaced apart elevated arms extending from the front surface supporting a plurality of spindles having a sheet of material hanging therefrom.
Figure 9:
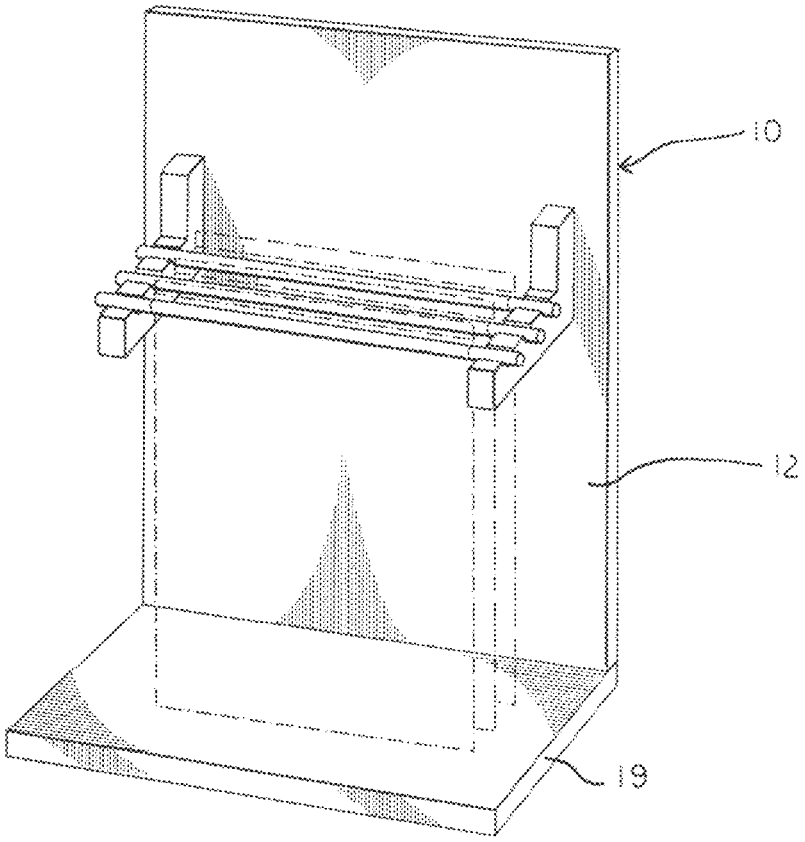
FIG. 9 is a perspective view of an alternate embodiment showing the panels of material in phantom lines.

A pair of spaced apart parallel support arms 16, 17 extend outwardly and normal to the front surface or face of the planar frame a selected distance above the base. Positioning means are provided at selected intervals on the support arms each one supporting an end of at least one and preferably a plurality of rods, spindles, or other longitudinal holding members as illustrated in FIGS. 1 and 9. Each longitudinal holding member supports a sheet extending between the arms. The sheet is formed of fabric, mesh or woven panels composed preferably of cloth, plastic, paper, or combinations thereof to which the earrings, pins and brooches are attached. Optional added design of ribbon or scallops 32 form a border around the panels. The material that is the base of the earring or pin support may be folded over or an additional sleeve may be sewn onto the sheet in order to hang on the rods. As shown, in FIG. 1, the upper distal end of the sheet of woven material may be folded over to form a conduit there through to corporately engage a support rod. It is contemplated that the woven sheet can be supported or attached to the rod by threads, loops, or other means of attachment The posts of the jewelry pieces pierce through the fabric and are held in place either by friction or by a cap which is pressed onto the end of the post or by a hook extending from the jewelry. The fabric panels are held in a spaced apart relationship on the support arms so that the jewelry on the panels behind the front panel are visible and the individual sheets or panels are easily removed for access or rearranged and organized toward the front for clearer viewing and use.

Figure 2:
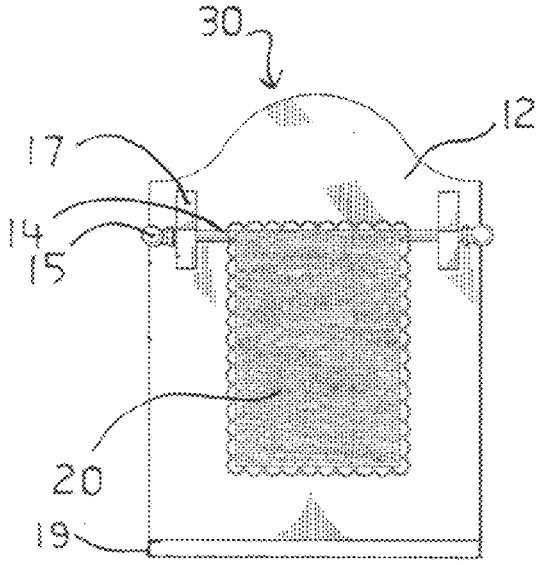
FIG. 2 is a front view of the earring organizer shown in FIG. 1.

More particularly in one preferred embodiment panels 20 are made from cloth, mesh, knitted or woven material or any similar material which is appropriate to organize earrings, pins, brooches or the like which may be attached by piercing the material with a supporting post which may include a cap pushed onto the end of that post. The woven panels 20 can include various adornments such as lace or appliques. The woven panel material shown in FIGS. 1, 2, and 8, are ornamental and the pattern is not claimed to be functional other than that the weave accommodates a pin or wire removably insertable there through. As shown in the figures, panels 20 are attached to longitudinal members 14 by stitching, adhesive, or by the addition of a longitudinal panel 13 near the rear upper edge of panel 20 to form a pocket which is open at each end. The upper and lower edges of panel 13 are stitched to panel 20, thus forming a pocket through which longitudinal member 14 is passed. With longitudinal member 14 installed in this pocket, the free ends 24 of longitudinal members 14 each extend beyond panels 13 and 20. The free ends 24 of longitudinal members 14 are place upon and cradled by support arms 16 and 17.

Figure 4:
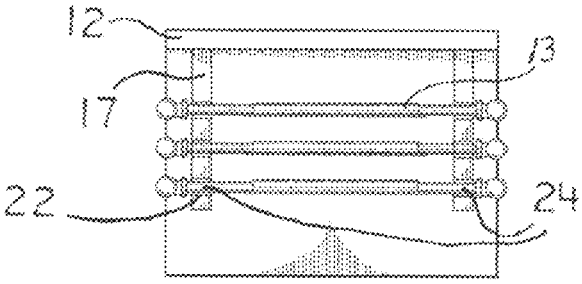
FIG. 4 is a top view of the earring organizer of FIG. 1 showing the spacing of the spindles supported by the elevated support arms.
Figure 5:
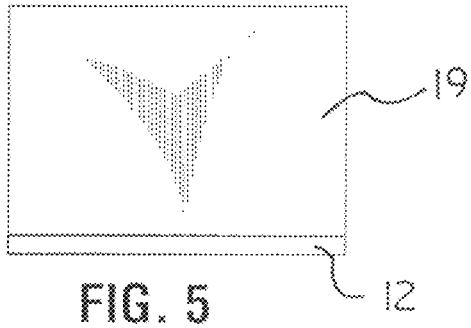
FIG. 5 is a bottom view of the earring organizer of FIG. 1 showing an optional base.
Figure 6:
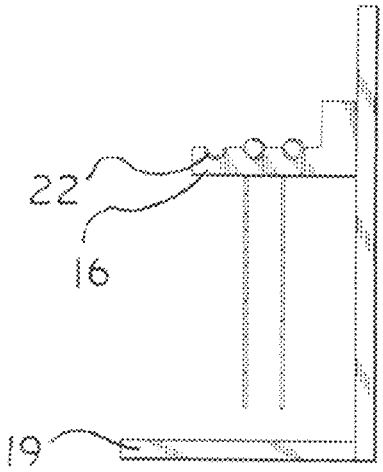
FIG. 6 is a right side view of the earring organizer of FIG. 1 showing support arms with spaced apart notches for holding three spindles wherein the outer spindle has been removed therefrom.
Figure 7:
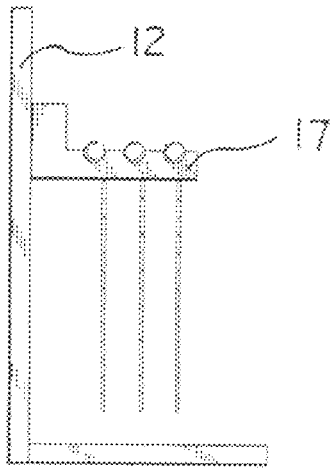
FIG. 7 is a left side view of the earring organizer of FIG. 1 showing three spindles and sheets extending therefrom supported by the support arms extending from the planar frame so that the sheets of material are removably supported above the base.

In FIG. 4, longitudinal members 14 include removable stop or retaining means 15 defining washers, spacers, end cap, or knobs attached via a slip fit facilitating removal of the sleeve for travel. The decorative shape of the stop or retaining means is a design choice and therefor nonfunctional. In another embodiment, longitudinal members 14 are provided without decorative members on each end.

Alternatively, the upper marginal edge of panel 20 may be looped back onto the rear side of panel 20 and attached by stitching to form a pocket through which longitudinal member 14 may be passed for the supporting of panel 20.

The preferred spacing of panels 20 of from about ¾ to 2 inches and preferably about 1 inch is maintained by spacing means comprising notches 22 formed in the upper surface of support arms 16 and 17. The notches shown in the figures are arcuate or U-shaped; however, the shape is a nonfunctional design choice and the notches could comprise square or v-shaped cutouts as well. Removable support rods provide a cursory viewing of jewelry held by adjacent panels 20 so that a user may easily find a desired article, after which, the user will bring the panel containing the desired article to the front and easily remove the article for use.

As noted the support arms 16 and 17 containing notches 22 receive the free ends 24 of longitudinal members 14 for the purpose of maintaining a selected spacing between adjacent panels. The preferred embodiment contains three panels, each of which is attached to a respective longitudinal member 14 and supported by arms 16 and 17. It is anticipated that jewelry organizer 10 contains at least two longitudinal members 14 with panels 20 but may contain any reasonable number which may be desired.

Figure 3:
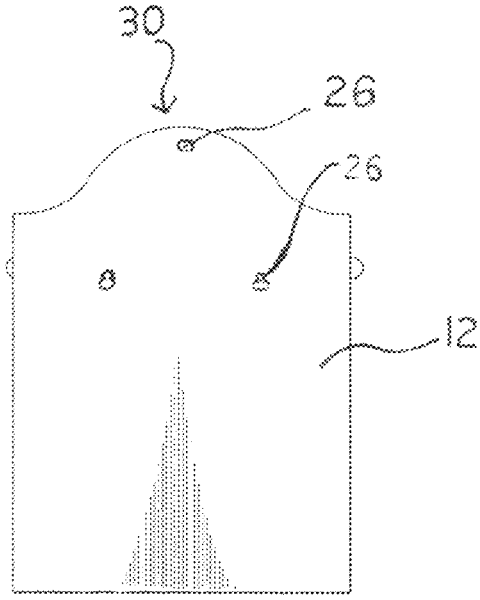
FIG. 3 is a rear view or the earring organizer showing a hanger.

An alternate embodiment 30 shown in FIGS. 2 and 3 contains no base member but is configured to be suspended from a wall or other vertical surface, rather than one which is supported by a base member. Jewelry organizer 30 includes a hole, notch, or cavity 26 which is located at the top center of the rear face of wall 12 and is configured to suspend jewelry organizer 30 from a hook, nail or screw, for example, which is fastened to and extending outward from a wall.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A jewelry organizer for removably holding at least one piece of jewelry having a piercing means extending therefrom consisting of:

a base member;

a vertical frame defining a panel rigidly attaching to and supported by said base member;

said frame including a pair of spaced apart parallel opposing support arms attached perpendicular to and projecting outwardly from said frame, said support arms being located at a selected position of above said base member, each one of said support arms terminating in a free end and being spaced apart from said base member;

said support arms each having at least one notch extending across a top surface thereof in a spaced apart relationship and at a selected distance from said frame, said at least one notch removably and corporately engaging a free end of a longitudinal member projecting a selected distance beyond said support arms parallel to said frame and in a spaced apart configuration from said frame;

said longitudinal members having removable stop means;

said longitudinal member having a pierceable panel suspended vertically downward therefrom, said pierceable panel composed of a woven material being capable of removably supporting and displaying jewelry, said jewelry being capable of being removably attached to said pierceable panel by piercing means attached to and extending from said jewelry, a free end of said piercing means being pushed into and through said pierceable panel and held in position by holding means; and holding means on a rear surface of said vertical frame for cooperatively engaging a vertical support surface.

2. A jewelry organizer for removably holding at least one piece of jewelry having a piercing means extending therefrom consisting of:

a base member;

a vertical frame defining a panel rigidly attaching to and supported by said base member;

said frame including a pair of spaced apart parallel opposing support arms attached perpendicular to and projecting outwardly from said frame, said support arms being located at a selected position above said base member, each one of said support arms terminating in a free end and being spaced apart from said base member;

said support arms each having a plurality of notches extending across a top surface thereof in a spaced apart aligned relationship and at a selected distance from said frame, said plurality of notches removably and corporately engaging a free end of at least two longitudinal members disposed parallel to one another and to said frame spaced apart from one another and from said frame, said longitudinal members projecting a selected distance beyond said support arms;

said longitudinal members having removable stop means;

said longitudinal members each having a pierceable panel composing a woven material suspended vertically downward therefrom, said pierceable panel being capable of removably supporting and displaying jewelry, said jewelry being capable of being removably attached to said pierceable panel by piercing means attached to and extending from said jewelry, a free end of said piercing means being pushed into and through said pierceable panel, whereupon a holding means holds said piercing means within said pierceable panel; and said base member attaching to a bottom surface of said vertical frame.

3. A jewelry organizer for removably holding at least one piece of jewelry having a piercing means extending therefrom consisting of:

a vertical frame defining a panel;

said frame including a pair of spaced apart parallel opposing support arms attached perpendicular to and projecting outwardly from said frame, said support arms being located at a selected position, each one of said support arms terminating in a free end;

holding means disposed on the rear surface of said vertical frame for cooperatively engaging a vertical support surface;

said support arms each having at least one notch extending across a top surface thereof in a spaced apart relationship and at a selected distance from said frame, said at least one notch removably and corporately engaging a free end of a longitudinal member, parallel to said frame and in a spaced apart configuration from said frame;

said at least one notch removably and corporately engage a free end of at least two longitudinal members disposed parallel to one another and to said vertical frame and in a spaced apart configuration from one another and from said frame, said longitudinal members projecting a selected distance beyond said support arms;

said longitudinal members having removable stop means;

said longitudinal members having a panel suspended vertically downward therefrom, said panel composing a woven material capable of removably supporting and displaying jewelry, said jewelry being capable of being removably attached to said panel by means of piercing means attached to and extending from said jewelry, the free end of said piercing means being pushed into and through said panel and held in position by holding means;

a base member attaching to a bottom surface of said vertical frame; and including holding means on a rear surface of said vertical frame for cooperatively engaging a vertical support surface.

* * * * *